US005412281A

United States Patent [19]

Farney et al.

[11] Patent Number: 5,412,281

[45] Date of Patent: May 2, 1995

[54] PHASE SMOOTHING CATHODE FOR REDUCED NOISE CROSSED-FIELD AMPLIFIER

[75] Inventors: George K. Farney, Boxford, Mass.; Chris L. Wheeland, Winfield, Pa.; Kenneth F. Ramacher; Edward M. Doyle, both of Montoursville, Pa.; Michael S. Worthington, Hughesville, Pa.

[73] Assignee: Litton Systems, Inc., Beverly Hills, Calif.

[21] Appl. No.: 40,514

[22] Filed: Mar. 31, 1993

[51] Int. Cl.[6] ..... H01J 23/05; H01J 25/42

[52] U.S. Cl. ..... 315/39.3; 330/47; 313/338; 313/356; 315/5.33

[58] Field of Search ..... 315/39.3, 5.11, 5.12, 315/5.33; 330/43, 47; 313/338, 356, 453–455, 106, 302

[56] References Cited

U.S. PATENT DOCUMENTS

| | | | |
|---|---|---|---|
| 2,832,005 | 4/1958 | Brown | 313/338 X |
| 3,278,791 | 10/1966 | Favre | 313/455 X |
| 3,307,065 | 2/1967 | Arnaud et al. | 313/455 X |
| 3,585,438 | 6/1971 | Bell | 313/338 |
| 3,899,714 | 8/1975 | Esterson et al. | 313/338 X |
| 4,380,717 | 4/1983 | Pickering | 313/338 X |
| 4,700,109 | 10/1987 | MacPhail | 315/39.3 |
| 4,763,043 | 8/1988 | MacMaster et al. | 313/446 X |
| 4,814,720 | 3/1989 | MacPhail et al. | 330/47 |
| 4,831,335 | 5/1989 | Wheeland et al. | 330/47 |
| 4,894,586 | 1/1990 | Crager et al. | 315/39.51 |
| 4,975,656 | 12/1990 | Schaeffer et al. | 330/42 |
| 5,130,601 | 7/1992 | Walker et al. | 313/15 |

FOREIGN PATENT DOCUMENTS

| | | | |
|---|---|---|---|
| 1587803 | 2/1991 | U.S.S.R. | 315/39.51 |

*Primary Examiner*—Benny T. Lee
*Attorney, Agent, or Firm*—Graham & James

[57] ABSTRACT

A crossed-field amplifier (CFA) includes a cylindrical cathode having an emitting surface coaxially disposed within an annular anode structure. The cathode has at least one circumferential groove disposed in the emitting surface. The grooves are relatively deep in comparison with their width. The grooves provide a phase smoothing of the rotating electron cloud spokes operative during crossed-field interaction. CFA noise is reduced by removal of the out-of-phase electrons. Due to their deeply cycloiding paths, these out-of-phase electrons become trapped in the grooves within a region generally shielded from the electric field of the CFA.

20 Claims, 4 Drawing Sheets

PHASE SMOOTHING CATHODE FOR REDUCED NOISE CROSSED-FIELD AMPLIFIER

GOVERNMENT CONTRACT

This invention has been developed under contract with the United States Government, Department of the Navy, Contract No. N00164-90-C-0119, which has a license to practice the invention.

BACKGROUND OF THE INVENTION

1. Field of the Invention

This invention relates to crossed-field amplifiers and, more particularly, to a cathode configuration for use in a crossed-field amplifier (CFA) which provides a reduction in noise output from the CFA.

2. Description of Related Art

Crossed-field amplifiers (CFAs) have been used for several years in electronic systems that require high RF power, such as radar systems. A CFA typically includes a central cylindrical shaped cathode coaxially disposed within an annular anode structure with an interaction region provided between the cathode surface and the anode. The anode structure may include a vane network which provides a slow wave path for propagation of an RF input signal. Upon application of an electric field between the cathode and the anode, the cathode surface emits a space-charge cloud of electrons. A magnetic field is provided perpendicular to the electric field, which causes the emitted electrons to spiral into cycloiding paths in orbit around the cathode. When RF fields are present on the slow wave structure, the rotating space-charge cloud is distorted into a spoke-like pattern. Electron current flows through the spokes from the cathode to the anode, with the spoke-like cloud rotating in phase with the phase velocity of the RF signal. The interaction between the electron current and the RF signal causes the signal to become amplified.

One problem typically experienced with CFAs is that of excessive noise resulting in the RF signal output. The noise is believed to be due to out of phase electrons emitted by the cathode which interact with the RF signal. These out-of-phase electrons generally follow deeply cycloiding paths and do not become drawn into the rotating spokes. This noise is also commonly referred to as phase jitter.

Numerous techniques have been applied in an attempt to reduce the undesirable noise level. Such techniques to reduce the CFA noise have included cathode driven CFAs, axial cathode slots, partially non-reentrant CFAs, and altered cathode materials. While some of these techniques yielded slight reduction in noise, each caused undesirable changes in CFA performance characteristics.

Another such technique is disclosed in U.S. Pat. No. 4,814,720, by MacPhail, which is assigned to the common assignee. MacPhail discloses the use of a slow wave structure on the cathode which is aligned with the slow wave structure of the anode. The cathode slow wave structure permits cross-coupling of the RF input from the slow wave structure of the anode, which sharpens the oscillation pattern of the electron beam.

Accordingly, a need exists to reduce the noise output from a crossed-field amplifier, while maintaining acceptable levels of CFA performance.

SUMMARY OF THE INVENTION

In addressing these needs and deficiencies in the prior art, an improved cathode for a reduced noise crossed-field amplifier is provided.

The crossed-field amplifier of the present invention includes a cylindrical cathode having an emitting surface coaxially disposed within an annular anode structure. The cathode has at least one circumferential groove disposed within the emitting surface. The groove is relatively deep in comparison with its width. In the preferred embodiment, there are at least three circumferential grooves.

It is believed that the groove provides a phase smoothing of the electron cloud spokes operative during crossed-field interaction. Noise on the electron cloud is reduced by removal of the out-of-phase electrons. Due to their deeply cycloiding paths, these electrons become trapped in the groove within a region generally shielded from the electric field of the CFA.

A more complete understanding of the improved cathode for a reduced noise crossed-field amplifier will be afforded to those skilled in the art, as well as a realization of additional advantages and objects thereof, by a consideration of the following detailed description of the preferred embodiment. Reference will be made to the appended sheets of drawings which will be first described briefly.

DESCRIPTION OF THE PREFERRED EMBODIMENT

The present invention provides an improved cathode to reduce the noise output from a crossed-field amplifier, while maintaining acceptable levels of CFA performance.

Figure 1:
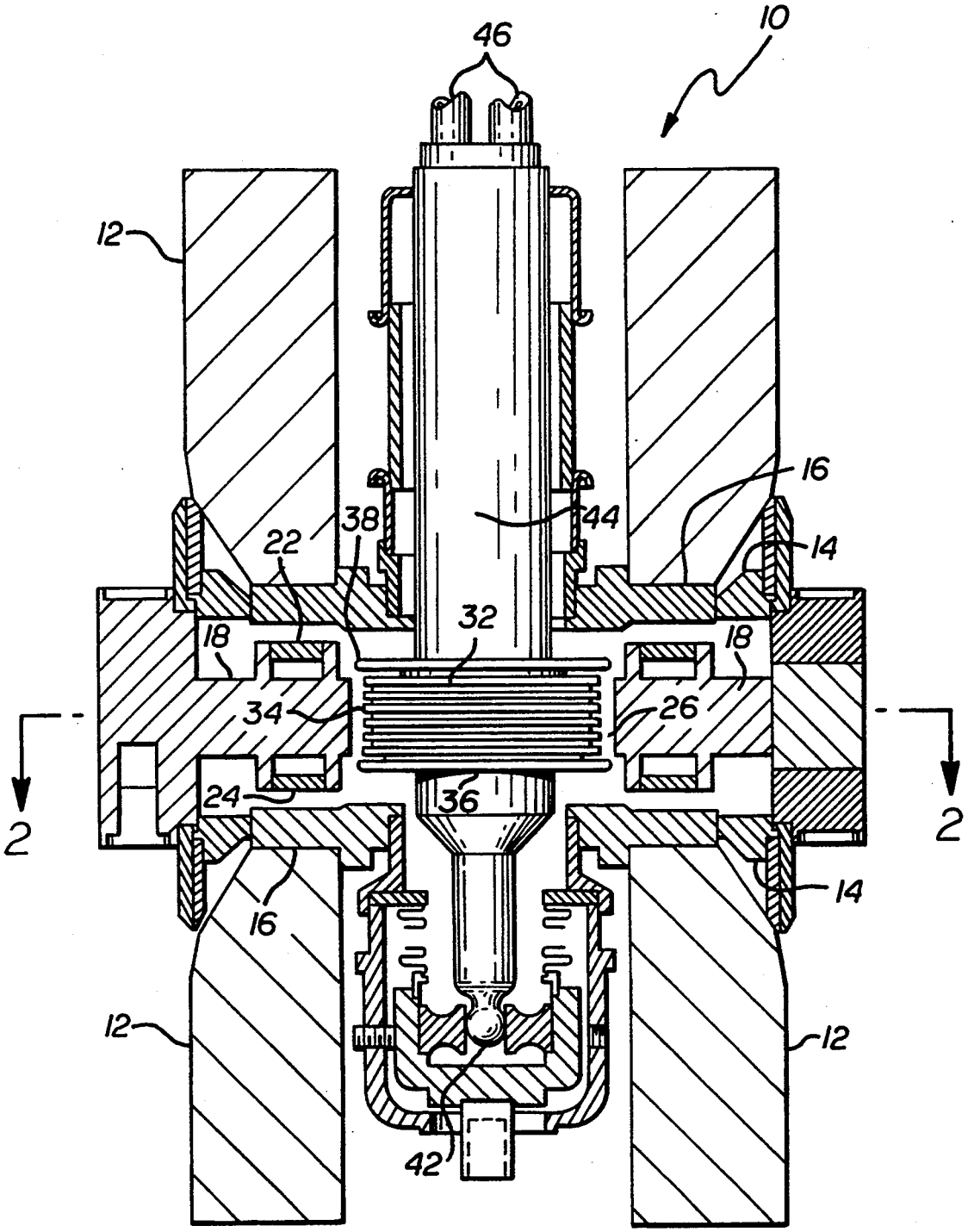
FIG. 1 is a cross-sectional side view of a crossed-field amplifier.

Referring now to the drawings, FIG. 1 shows a crossed-field amplifier 10 formed between a pair of hollow, cylindrically shaped permanent magnets 12. The pair of magnets 12 are mounted above and below a body ring 14 of the CFA, which forms part of the anode as will be fully described below. The body ring 14 is sealed by a cover 16 which secures to the magnets 12.

A plurality of anode vanes 18 extend radially inward from the inner surface of the body ring 14. The vanes 18 are electrically connected together by machined helices 22 and 24. Helices 22 and 24, vanes 18, and body ring 14 are all electrically connected together to form the anode. Although machined helices 22 and 24 are shown in FIG. 1, it is also known in the art to use a wire coil helix having windings which are electrically connected to the anode vanes 18. The inventive concepts described herein are equally applicable to either a CFA having a wire coil or machined helix.

A cathode 32 is coaxially disposed within the body ring 14 and is surrounded by the radially extending anode vanes 18. The cathode 32 has a cylindrically shaped emitting surface 34, and an upper and lower end shield 38 and 36, respectively, disposed at each end of the emitting surface. The emitting surface 34 is generally formed of beryllium. A cathode terminal 42 is provided with a high negative voltage, such as −13 KV, through a central bore in the lower magnet 12. A mechanical support rod 44 secures to the upper end shield 38, providing structural support for the cathode 32. A plurality of coolant tubes 46 extend axially through the mechanical support rod 44, to provide a coolant fluid to maintain the cathode 32 and emitting surface 34 at a constant temperature.

Figure 2:
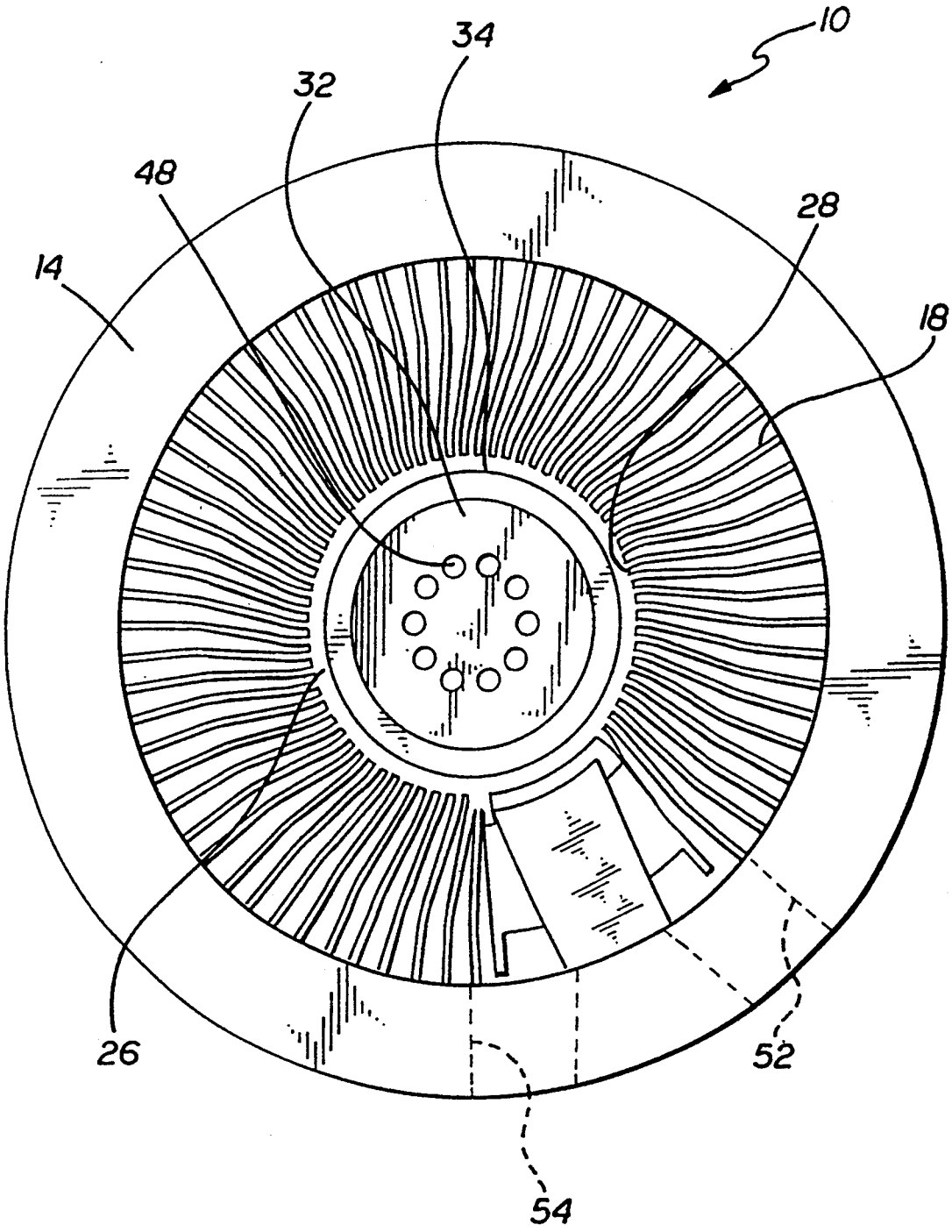
FIG. 2 is a cross-sectional top view of the crossed-field amplifier of FIG. 1, as taken through the section 2—2.

Referring now to FIG. 2, a cross-sectional top view of the CFA structure 10 of FIG. 1 is illustrated. The view shows the cathode 32 coaxially disposed within the plurality of radially extending anode vanes 18 which are secured to the body ring 14. A plurality of coolant holes 48 extend axially through the cathode 32 which are joined to the coolant tubes 46 described above with respect to FIG. 1. An RF input port 52 and an RF output port 54 extend through the body ring 14 to provide an input and an output path for an RF signal provided to and from the CFA, respectively. An interaction region 26 (see also FIG. 1) is provided between the cathode surface 34 and the tips 28 of the anode vanes 18.

In operation, a high negative voltage is applied to the cathode 32 relative to the anode vanes 18. The voltage causes electrons to be emitted from the cathode surface 34, producing a space-charge cloud of electrons surrounding the cathode. The magnets 12 provide a magnetic field which lies perpendicular to the electric field formed within the interaction region of the CFA structure 10. The magnetic field causes the electrons to orbit around the cathode structure 32 in a rotating sheath or hub.

Figure 6:
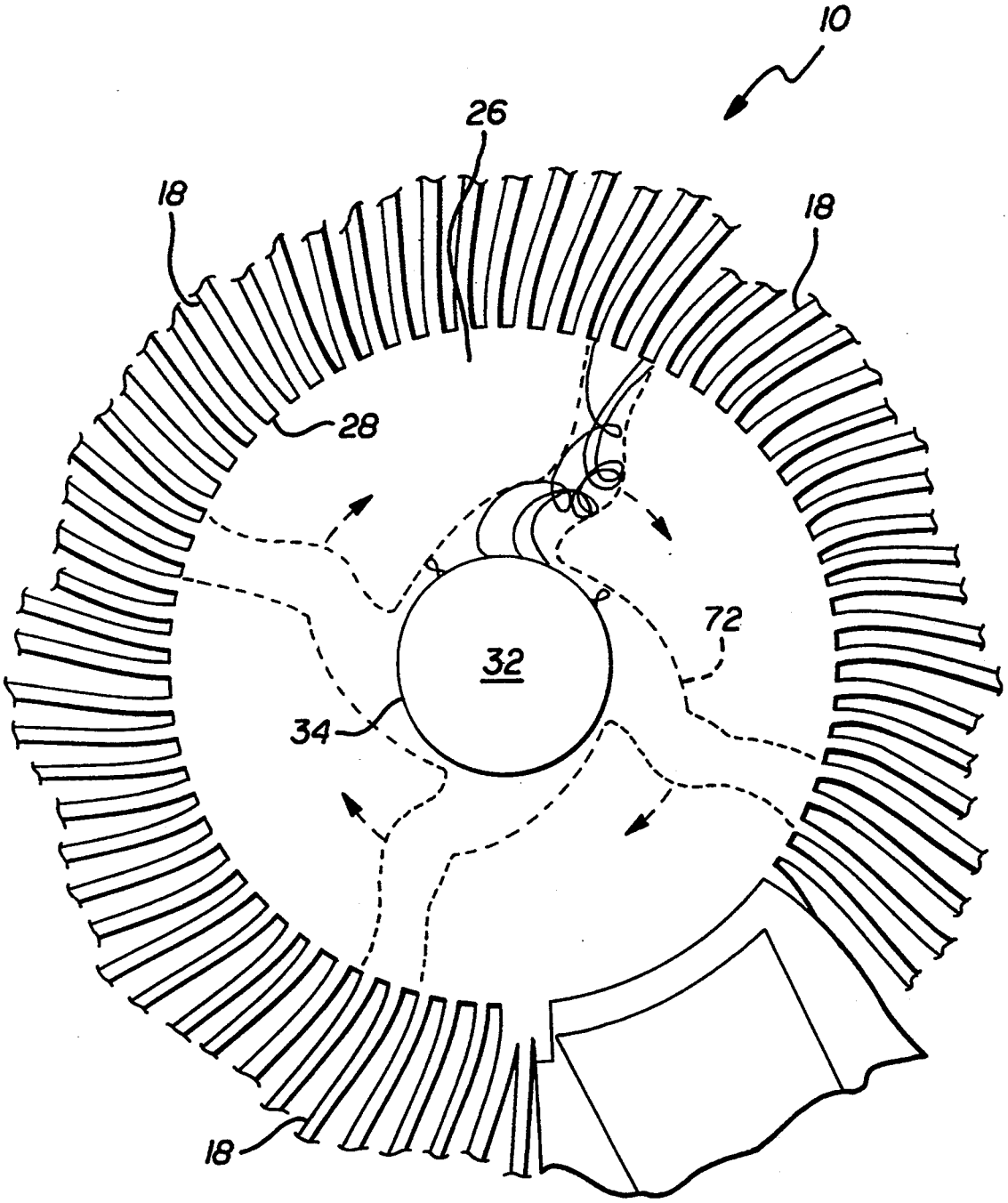
FIG. 6 is a cross-sectional top view of the crossed-field amplifier as in FIG. 2, illustrating a spoke-like electron cloud.

The application of the RF signal onto the anode causes the rotating space-charge cloud to distort into a spoke-like pattern, as illustrated in FIG. 6. Although FIG. 6 is not drawn to scale, the spoke-like cloud 72 is illustrated within an enlarged interaction region 26 disposed between the vane tips 28 and the surface 34 of the cathode structure 32 of the CFA 10. The figure illustrates a cloud 72 having four spokes for illustrative purposes only, however, the actual number of spokes would be higher, such as sixteen. The number of spokes depend on the number of vanes 18 and the phase shift of the RF signal traveling on the anode. The angular velocity of rotation of the spoke-like cloud 72 is locked to the phase velocity of the potential wave of the RF signal. Energy from the orbiting electrons is exchanged with the RF signal, causing the signal to become amplified. An amplified RF signal exits the CFA 10 through the output port 54 (see FIG. 2).

Figure 4:
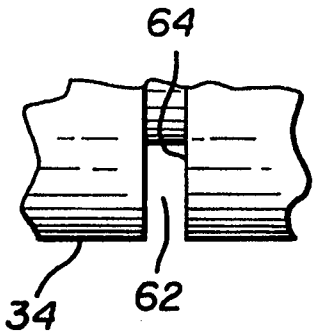
FIG. 4 is an enlarged view taken from FIG. 3 of the circumferential grooves.
Figure 3:
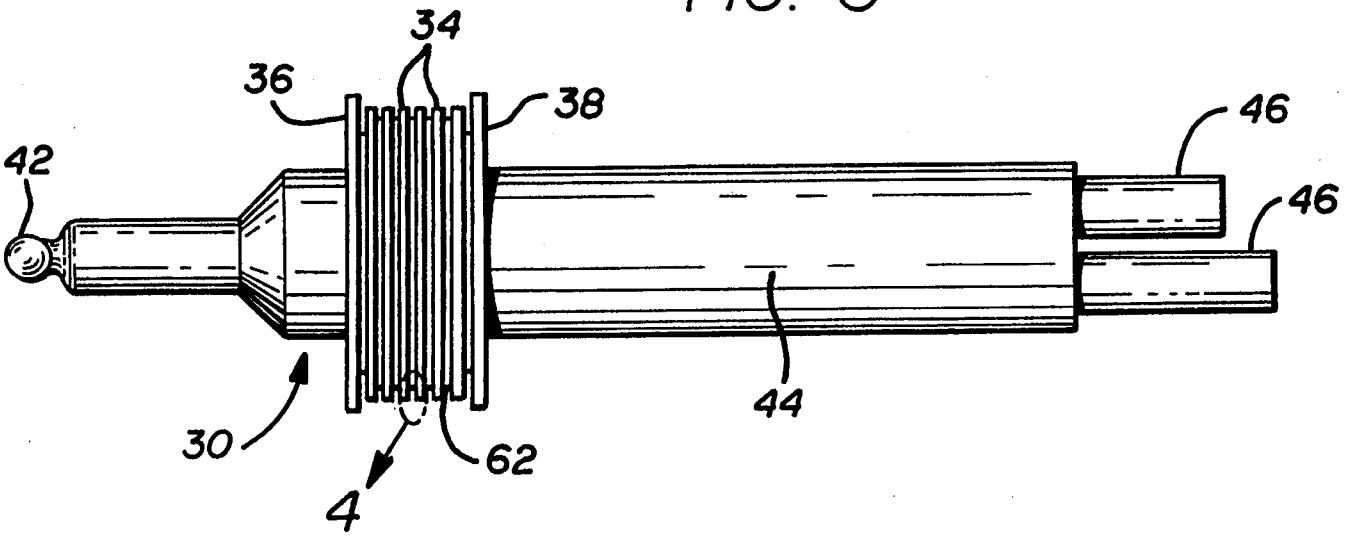
FIG. 3 is a side view of the cathode structure showing circumferential grooves disposed in the cathode emitting surface.
Figure 5:
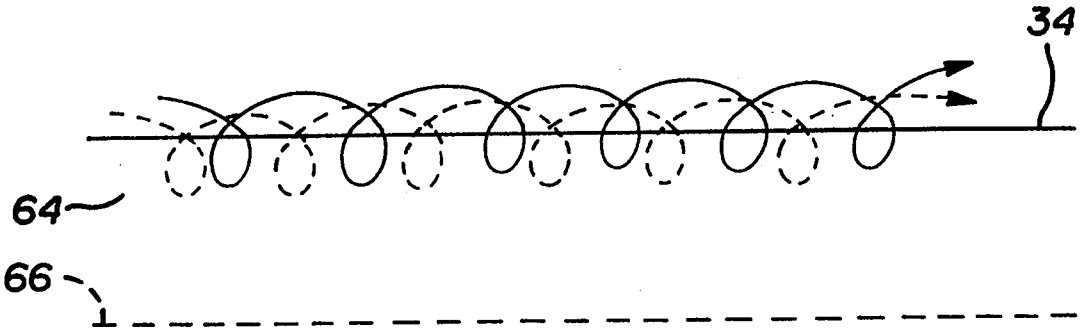
FIG. 5 illustrates a cycloidal electron trajectory relative to a circumferential slot of the present invention.

Referring now to FIGS. 3 and 4, a cathode structure 30 (see FIG. 3) for use in the CFA 10 of the present invention is illustrated. The cathode structure 30 of FIG. 3 includes the upper end shield 38, the lower end shield 36, the cathode terminal 42, the mechanical support rod 44, and the coolant tubes 46 of FIG. 1. Rather than utilizing a generally continuous smooth surface for the emitting surface 34, at least one groove and preferably a plurality of circumferential grooves are provided in the surface. The grooves 62 are relatively deep as compared to their width, having a bottom surface 66 as illustrated in FIG. 5. It is preferred that the grooves be at least twice as deep as their width, as illustrated in FIG. 4. The grooves 62 form opposing sidewalls 64 (see FIG. 4) which are generally perpendicular to the emitting surface 34. The grooves 62 can be formed in the cathode surface 34 by conventional machining processes, or by electro-discharge machining (EDM).

In the embodiment illustrated in FIG. 3, there are seven grooves 62. Operational tests have demonstrated noise reduction improvements with cathode configurations having four, five and nine grooves, with optimum performance improvement occuring in the five groove configuration. It is believed that odd numbered groove configurations would have superior performace due to the inclusion of a centrally disposed groove in the cathode emitting surface 34.

While the theory of operation is not essential to making or using the invention, it is believed that the grooves 62 provide a phase smoothing of the electron cloud spokes during the crossed-field interaction. Electrons which are out-of-phase with the spokes follow deeply cycloiding paths, as illustrated in FIG. 5. These cycloiding electrons fall within the grooves 62 below the emitting surface 34 (see FIG. 5) and become shielded from the electric field within the CFA 10. Once trapped within the groove 62, the electrons travel along the magnetic field lines which pierce the cathode surface 34, and are collected on the groove walls 64 (see FIG. 5).

Despite the reduction of cathode emitting surface area, the use of the grooves are not believed to degrade crossed-field amplifier performance due to reduced electron cloud density, as in the prior art. It is intended that the crossed-field amplifier operate space-charge limited, rather than electron limited, so that the amount of emitted electrons is more than sufficient to obtain the performance objectives of the amplifier.

Even if this theory of operation is later shown to be not entirely accurate, the effectiveness of the invention is undisputed. Operational tests have demonstrated that the grooved cathode reduces the CFA noise by at least 3 to 4 dBc/MHz as measured by a standardized technique. This is achieved without loss of output power, or by requiring a reduction in cathode voltage, which has often been the case with the previous methods described above.

Having thus described a preferred embodiment of cathode for a reduced noise crossed-field amplifier, it should now be apparent to those skilled in the art that certain advantages of the within system have been achieved. It should also be appreciated that various modifications, adaptations, and alternative embodiments thereof may be made within the scope and spirit of the present invention. The invention is further defined by the following claims.

What is claimed is:

1. In a low noise crossed-field device, an improvement comprising:

a cylindrical cathode coaxially spaced from and surrounded by an annular anode structure and having an emitting surface; and at least one circumferential groove disposed in said emitting surface, wherein out-of-phase electrons emitted by said emitting surface are collected within said at least one groove.

2. The improvement to a crossed-field device of claim 1, wherein said at least one groove comprises at least five grooves.

3. The improvement to a crossed-field device of claim 1, wherein said at least one groove has a depth at least twice as great as a width of said at least one groove.

4. The improvement to a crossed-field device of claim 1, wherein said emitting surface comprises beryllium.

5. The improvement to a crossed-field device of claim 1, wherein said at least one groove further comprises corresponding side walls which collect said out-of-phase electrons emitted by said emitting surface.

6. The improvement to a crossed-field device of claim 1, wherein said at least one groove comprises an odd number of grooves, and one of said grooves is centrally disposed on said emitting surface.

7. A low noise crossed-field amplifier having a cylindrical cathode coaxially spaced from and surrounded by an annular anode structure, said cathode having an emitting surface which emits a cloud of electrons, said electron cloud rotating about said cathode in an interaction area disposed between said emitting surface and said anode structure in response to a magnetic field applied thereto, said crossed-field amplifier comprising:

means disposed in said cathode for phase smoothing said rotating electron cloud during crossed-field interaction by removing out-of-phase electrons from said cloud, said phase smoothing means collecting said out-of-phase electrons;

wherein an RF signal traveling on said anode structure is amplified by said crossed-field interaction with said rotating cloud of electrons.

8. The crossed-field amplifier of claim 7, wherein said phase smoothing means comprises at least one circumferential groove disposed in said emitting surface.

9. The crossed-field amplifier of claim 8, wherein said at least one groove comprises at least five grooves.

10. The crossed-field amplifier of claim 8, wherein said at least one groove has a depth at least twice as great as a width of said at least one groove.

11. The crossed-field amplifier of claim 8, wherein said at least one groove comprises an odd number of grooves.

12. A low noise crossed-field amplifier, comprising:

a cylindrical cathode coaxially spaced from and surrounded by an annular anode structure, said cathode having an emitting surface which emits a cloud of electrons, said electron cloud rotating in orbit about said cathode in an interaction area disposed between said emitting surface and said anode structure in response to a magnetic field applied thereto; and at least one circumferential groove disposed within said emitting surface;

wherein, said at least one groove providing phase smoothing of the rotating electron cloud during crossed-field interaction by removing out-of-phase electrons from said cloud, and an RF signal input into said crossed-field amplifier is amplified by said crossed-field interaction with said rotating electron cloud.

13. The crossed-field amplifier of claim 12, wherein said at least one groove comprises at least five grooves.

14. The crossed-field amplifier of claim 12, wherein said at least one groove has a depth at least twice as great as a width of said at least one groove.

15. The crossed-field amplifier of claim 12, wherein said at least one groove further comprises corresponding side walls which collect said out-of-phase electrons.

16. The crossed-field amplifier of claim 12, wherein said at least one groove comprises an odd number of grooves, and one of said grooves is centrally disposed on said emitting surface.

17. An electron gun for a microwave generating device having crossed electric and magnetic fields, comprising:

a cylindrical cathode having an electron emitting surface; and at least one circumferential groove disposed in said emitting surface, wherein out-of-phase electrons emitted by said emitting surface are collected within said at least one groove.

18. The electron gun of claim 17, wherein said at least one groove has a depth at least twice as great as a width of said at least one groove.

19. The electron gun of claim 17, wherein said emitting surface comprises beryllium.

20. The electron gun of claim 17, wherein said at least one groove comprises an odd number of grooves, and one of said grooves is centrally disposed on said emitting surface.

* * * * *